US005247707A

United States Patent [19]

Parker et al.

[11] Patent Number: 5,247,707

[45] Date of Patent: Sep. 28, 1993

[54] UTILITY VEST WITH AN INTEGRALLY CARRIED PACK

[76] Inventors: David M. Parker; Susan M. Parker, both of 2308 W. Dayton, Flint, Mich. 48504

[21] Appl. No.: 945,372

[22] Filed: Sep. 16, 1992

[51] Int. Cl.[5] ..... A41D 1/04

[52] U.S. Cl. ..... 2/102; 2/94; 2/108; 2/85

[58] Field of Search ..... 2/94, 95, 96, 102, 108, 2/93, 85, 310; 224/208, 209, 210, 211, 215, 216

[56] References Cited

U.S. PATENT DOCUMENTS

| | | | |
|---|---|---|---|
| 2,304,574 | 12/1942 | Kirschenbaum | 2/94 |
| 2,368,654 | 2/1945 | Frank | 2/94 |
| 2,437,714 | 3/1948 | Thomason, Jr. | 2/310 |
| 2,755,480 | 7/1955 | Jones et al. . | |
| 2,970,316 | 2/1961 | Silin | 2/94 |
| 3,354,470 | 11/1967 | Allen | 2/94 |
| 3,403,407 | 10/1968 | Bishop et al. . | |
| 4,068,314 | 1/1978 | Yellen et al. | 2/94 |
| 4,079,467 | 3/1978 | Baldwin . | |
| 4,272,852 | 6/1981 | Bell | 2/94 |
| 4,369,526 | 1/1983 | Clutts . | |
| 4,389,735 | 6/1983 | McLaughlin | 2/94 |
| 4,502,154 | 3/1985 | Itoi | 2/108 |
| 4,515,300 | 5/1985 | Cohen | 224/153 |
| 4,563,777 | 1/1986 | Park | 2/108 |
| 4,637,075 | 1/1987 | Ingrisano et al. . | |
| 4,669,127 | 6/1987 | Swanson . | |
| 4,825,471 | 5/1989 | Jennings | 2/94 |
| 4,947,870 | 8/1990 | Larcher | 2/310 |
| 4,955,456 | 9/1990 | Mulkey | 2/94 |
| 5,014,359 | 5/1991 | Hanson . | |
| 5,024,360 | 6/1991 | Rodriguez | 2/94 |
| 5,038,410 | 8/1991 | Grilliot et al. | 2/94 |
| 5,129,560 | 7/1992 | Herman | 224/153 |

FOREIGN PATENT DOCUMENTS

| | | | |
|---|---|---|---|
| 1565553 | 3/1969 | France | 2/94 |
| 266133 | 7/1929 | Italy | 2/94 |

*Primary Examiner*—Clifford D. Crowder
*Assistant Examiner*—Gloria Hale
*Attorney, Agent, or Firm*—Richard C. Litman

[57] ABSTRACT

A utility vest with a pair of straps running through the shoulder areas of the vest and terminating in loops that extend proximate to the outer surface of the garment. These straps are engageable with a belt and thereby transfer the weight of items clipped or otherwise attached to the belt to the shoulders of the user, preventing the belt from riding low or sliding down around the user's hips. Additionally, there are a number of pleated and unpleated pockets disposed about the inner and outer surfaces of the vest. On the rear panel of the vest, one of these pockets has contained within it a folded backpack that is integrally attached to the vest. The backpack has a pair of loops on its anterior surface that cooperate with the belt, thus holding the deployed backpack substantially stationary relative to the vest.

12 Claims, 2 Drawing Sheets

UTILITY VEST WITH AN INTEGRALLY CARRIED PACK

BACKGROUND OF THE INVENTION

1. Field of the Invention

The present invention relates to clothing. More specifically, it relates to a vest having a number of utilitarian features. Even more specifically, it relates to a utility vest having a plurality of differently sized pockets, one of these pockets, located on the back of the vest, containing a backpack integral with the vest that can be unfolded and used to carry bulky items, such as coats or sweaters, that would not otherwise fit into the pockets of the vest.

2. Description of the Prior Art

In many types of outdoor activities, it is useful, sometimes even vital, to have many pockets in the garments that one is wearing. In hunting, hiking, or any similar type of activity where the participant is in a wilderness or near wilderness area, the possibility of becoming lost, having an accident, or merely becoming separated from the group one is with is a real possibility that must be taken into account by any responsible, intelligent person. Inclement weather conditions in combination with one of the above mishaps could turn spending an unplanned night out in the open from a minor annoyance to a potentially life threatening situation. Preparing for this possibility, then, mandates the carrying of all necessary equipment to keep one comfortable in the eventuality that an unplanned camping trip becomes a reality. This equipment, however light and compact, is too bulky to be put into one's pants or coat pockets. A backpack is usually carried when camping for an extended period but, especially while hunting, a backpack is too large and clumsy to allow the proper stalking of game or the free movement that is required when passing through difficult terrain. Another concern is that in the course of many outdoor activities there is a temperature change over the course of the day. In the morning, for example, the temperature could hover near freezing, while during the middle of the day it may reach 50 or 60 degrees Fahrenheit. This leads to the well known practice of "layering" the clothing worn. As the temperature rises, or body heat is generated by exertion, the layers are removed one by one. A problem arises, however, as to what to do with these garments once they are shed. What is needed is a garment that allows free movement and yet can carry a sufficient amount of equipment to deal with an emergency and, additionally, provides an expandable storage space for coats, sweaters, and the like when conditions change.

U.S. Pat. No. 3,403,407 issued on Oct. 1, 1968 to Edward W. Bishop et al. discloses a rifle jacket that includes a specially designed area to take up the recoil. There are two bellows pockets, designated 26 in the Figures. On the other hand, the present invention provides more pockets in both the front and back and an expandable amount of storage space.

U.S. Pat. No. 4,079,467 issued on Mar. 21, 1978 to Robert O. Baldwin discloses a parent-child coat. This has an elongated cutout covered by a pocket to allow the child to be carried and, simultaneously, be monitored by the parent.

U.S. Pat. No. 2,755,480 issued on Jul. 24, 1956 to Gilbert H. Jones et al. discloses a hunting vest where in a double pocket on the rear of the device, of waterproof or blood-proof construction, is provided for the carrying of game.

U.S. Pat. No. 4,369,526 issued on Jan. 25, 1983 to Earnest H. Clutts discloses a utility vest having a detachable apron that is secured by a zipper.

U.S. Pat. No. 5,014,359 issued on May 14, 1991 to James M. Hanson discloses a vest and backpack combination. The device is adjustable to the size of the user, and some pockets are removable. In contrast with the instant invention, the backpack is not foldable so it can be stowed in a rear pocket.

U.S. Pat. No. 4,637,075 issued on Jan. 20, 1987 to Louis A. Ingrisano et al. discloses an emergency medical services system. The system uses vest jackets that are provided with a plurality of pockets to carry EMS gear. When compared with the present invention, it can be seen that there is no foldable, integral backpack taught in this disclosure.

U.S. Pat. No. 4,669,127 issued on Jun. 2, 1987 to Richard A. Swanson discloses a pack vest. The device has a load carrying compartment on the back and a plurality of pockets. However, the load carrying component is not foldable into a smaller area.

None of the above inventions and patents, taken either singly or in combination, is seen to describe the instant invention as claimed.

SUMMARY OF THE INVENTION

The present invention is a utility vest with a pair of straps running through the shoulder areas of the vest and terminating in loops that extend proximate to the outer surface of the garment. These straps are engageable with a belt and thereby spread the weight of items clipped or otherwise attached to the belt to the shoulders of the user, preventing the belt from riding low or sliding down around the user's hips. Additionally, there are a number of pleated and unpleated pockets disposed about the inner and outer surfaces of the vest. On the rear panel of the vest, one of these pockets has contained within it a folded backpack that is integrally attached to the vest. The backpack has a pair of loops that cooperate with the belt mentioned above, for holding the deployed backpack substantially stationary relative to the vest.

Accordingly, it is a principal object of the invention to have a pair of supporting straps that pass over the shoulder areas of the vest and terminate in loops that extend through to the outside of the vest, providing support for a belt and spreading the weight of items attached to the belt to the shoulder area of the user, thus to prevent the belt from riding low or sliding down around the hips of the user.

It is another object of the invention to provide a vest that contains a plurality of pockets for the stowing of various items that could conceivably be needed by the user.

It is a further object of the invention to have a foldable backpack contained in one of the pockets of the vest.

It is yet a further object of the invention to provide an expandable storage space for clothing that needs to be doffed in the case of outside temperature rising or because of bodily exertion.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Referring to now to the figures, the utility vest is designated 10. The vest has an inner liner L, shown in FIGS. 2 and 4 made of cotton, nylon, silk, or any number of other similar materials well known in the art. In the preferred embodiment, the vest is made out of a sturdy cotton/polyester material, though a number of other materials could be used for the outer body of the vest 10 such as nylon or GORE-TEX (a registered Trademark of W.L. Gore & Associates), the latter being a breathable, water repellent laminate. It is important, though, that the device as a whole should be of sufficiently light weight that it will be comfortable even in warm weather.

Figure 1:
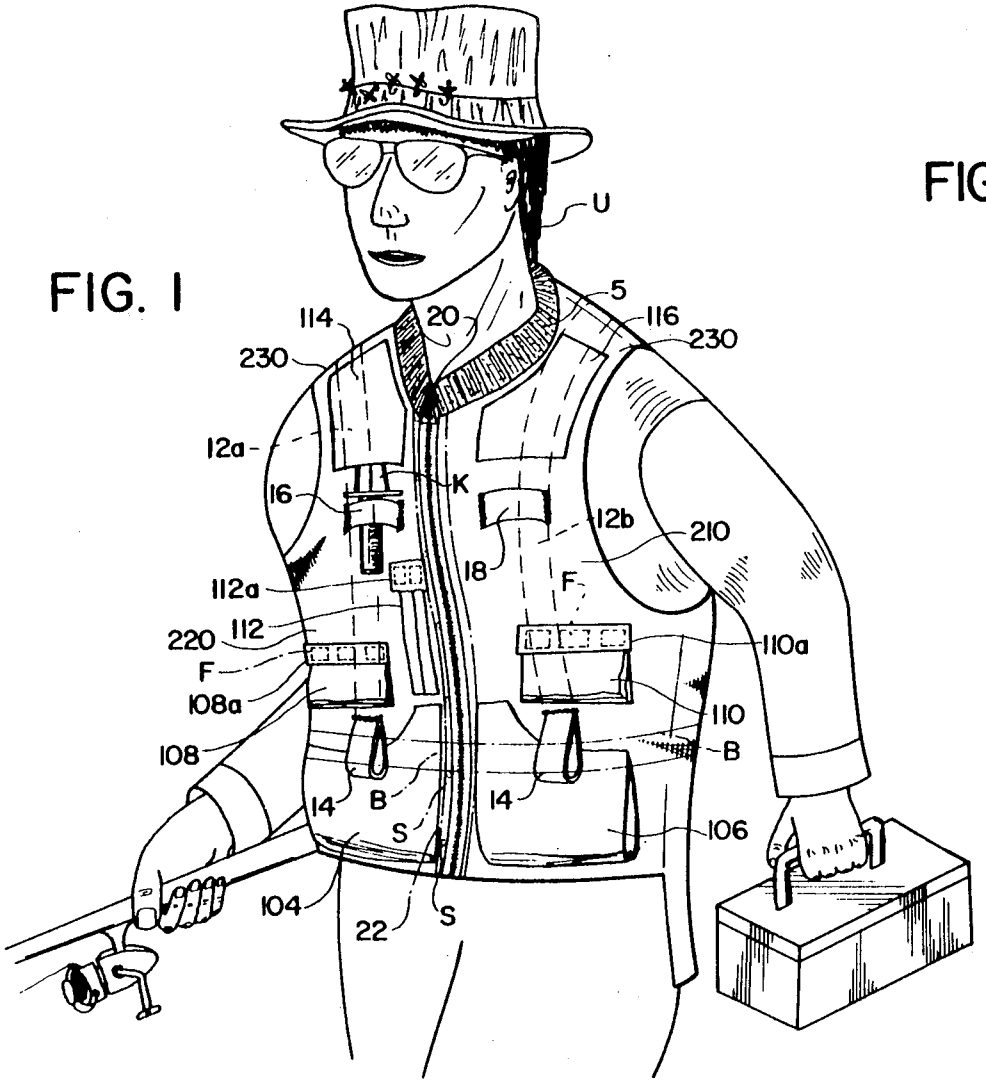
FIG. 1 is an environmental perspective view of the utility vest with the waist encircling belt shown in phantom lines and the supporting straps running over the shoulder area shown in broken lines.

The vest 10 is divided into four main areas, namely a back panel 200, the front left panel 210, a front right panel 220, and a shoulder area 230 that is proximate to a neck opening 5. The two front panels 210, 220 are sewn to the back panel 200 so that no raw seams will show. In FIG. 1, the two supporting straps 12*a* and 12*b* are shown in broken lines. These straps run along interiorly of the vest 10, preferably between the exterior of the vest 10 and the liner L (shown in FIGS. 2 and 4). The ends of the two straps 12*a* and 12*b* are shown in FIGS. 1 and 3, protruding through the vest 10 and terminating in belt loops 14. In the preferred embodiment of the invention, these supporting straps and loops are made of reinforced nylon webbing such as is used for car seatbelts and the like. Other materials will of course be apparent to anyone of ordinary skill in the art. Standard nylon webbing having the proper width for comfort could be used. The vest has a neck 5 which is made of a suitable material such as polypropylene, nylon, polyester, another synthetic fabric, cotton or another natural fabric to provide the user U (as seen in FIG. 1) with warmth and comfort.

Figure 4:
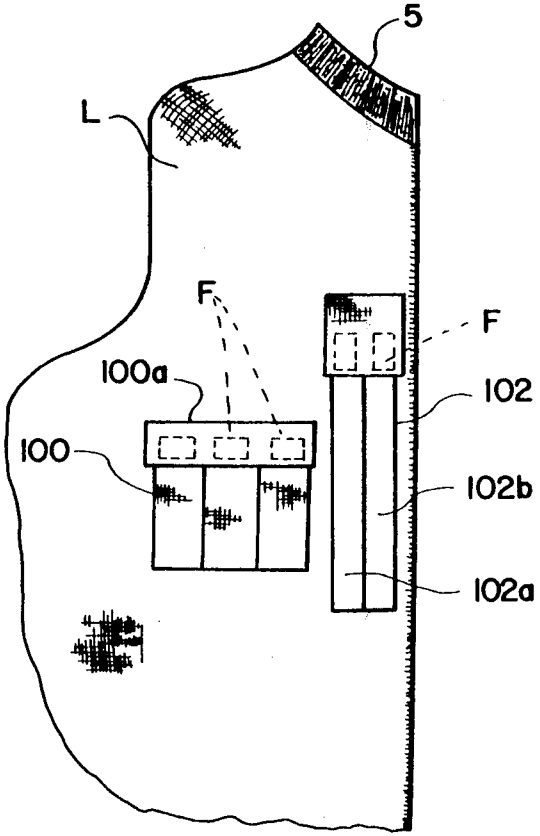
FIG. 4 is a partial view of the interior of the vest showing the inner pockets.

Seen in FIG. 4 are two internal pockets, 100 and 102. The pocket 100, has a closure 100*a* that is sealable by fasteners F, (of hook and loop type preferably, though other types could be substituted) and the other internal pocket 102 is longer and is divided longitudinally as by stitching into two compartments. These compartments 102*a* and 102*b* are designed to hold articles such as flashlights or emergency chemical activated type lights. In FIG. 1, showing the front of the vest 10 with the right front panel 220 and the left front panel 210, there are two large bellows pockets 104 and 106 disposed toward the bottom of the vest 10, one on each of the front panels 210, 220. These pockets do not have covering closures, but of course it would be obvious to provide them if desired. If the user wishes, a belt B (shown in phantom lines in FIGS. 1 and 3) runs through the belt loops 14, serving as it does to cover and close pockets 104 and 106.

Two smaller pockets 108 and 110 are also disposed on the front of the vest 10, one on each of the upper parts of front panels 210, 220. These pockets are provided with closures 108*a* and 110*a* having fasteners F (again preferably of the hook and loop type) to keep them closed when desired. Another pocket 112 with a closure 112*a* is on the front of the vest 10. This pocket is similar to the long, thin internal pocket 102 described above. It is shown in FIG. 1 divided longitudinally by stitching or other similar means.

Proximate to the shoulder area 230 and neck opening 5 of the vest 10, on either side of the neck opening 5, are two upside down pockets 114 and 116. Beneath them are two horizontally disposed protruding loops 16 and 18. The upside down pockets 114, 116 and protruding loops 16, 18 provide two locations on the front of the vest 10 where a knife K can be placed. To facilitate the placement and removal of the knife K, the protruding loops 16, 18 could be made of a stiff, slightly elastic material. The vest 10 is provided with a zipper 20, constructed of a suitable material such as a rustproof metal or resilient, durable plastic. Attached adjacent to the zipper 20 is a storm flap 22, shown here in phantom lines, with suitable fastening means, such as snaps S (shown in broken lines). It should be understood that other types of fasteners such as hook and loop type, or even another zipper could be used. Optionally, during firearm season, the vest could have a lightweight outer shell of bright day-glo orange as many states require in hunting season.

Figure 2:
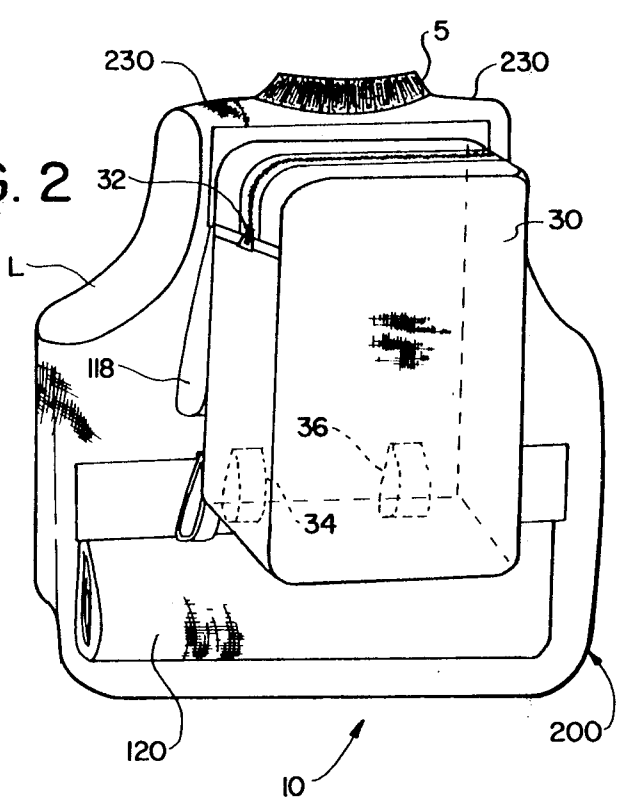
FIG. 2 is a rear perspective view of the vest with the integrally attached backpack deployed.
Figure 3:
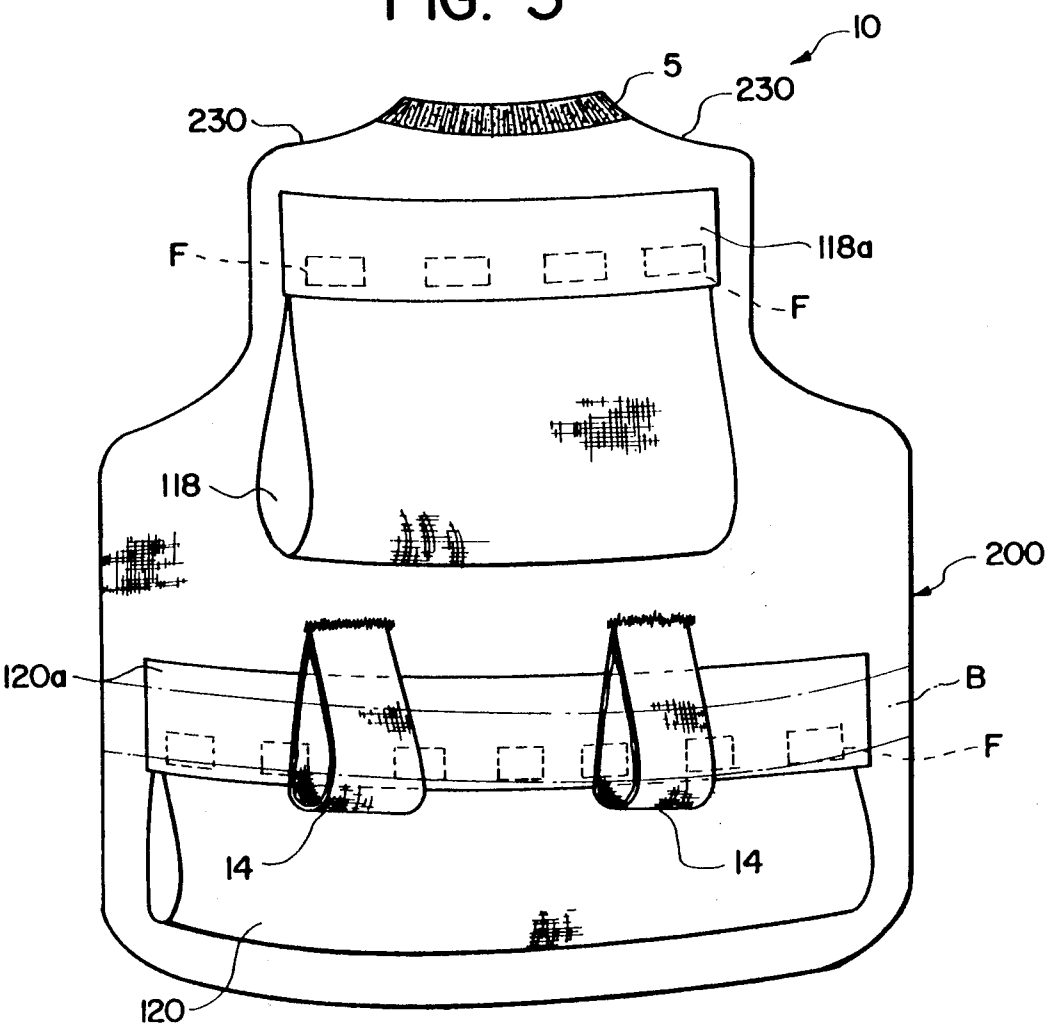
FIG. 3 is a rear view of the vest with the backpack enclosed in its storage pocket.

Referring now to FIG. 2, the back of the vest 10 is shown with the integrally stored backpack 30 deployed out of its storage pocket 118. The storage pocket 118 and, underneath it, the larger pocket 120, for use in holding a poncho or a like article, both have closures 118*a* and 120*a*. These are clearly seen in FIG. 3. These closures 118*a*, 120*a* are provided with hook and loop type fasteners F to keep them closed when desired, though other types of fastening devices could obviously be substituted. Returning to FIG. 2, the backpack 30, which is secured just under the closure 118*a*, has a zipper 32 that extends laterally across its top and partially down both of its sides. This zipper 32, like zipper 20, may be made of a rustproof metal, a resilient, durable plastic, or any other suitable material. The backpack 30 also has, on its anterior face, two protruding loops 34 and 36. These are shown in broken lines in FIG. 2 and they are positioned at about the same distance from the bottom of the vest 10 as the belt loops 14. If the user wishes, these loops 34, 36 can be engaged with the belt B when the backpack 30 is deployed out from its storage pocket 118, and thus engaged, these loops 34, 36 hold the backpack 30 substantially stationary relative to the vest 10. An important advantage of the belt B being able to cooperate with the belt loops 14 (shown in FIGS. 1 and 3) in this manner is that if the user U wishes to clip various articles to the belt B, the weight will be transferred through the belt loops 14 to the supporting straps 12*a* and 12*b* that, by passing through the shoulder area 230 when the vest 10 is worn, thereby transfer the weight of any attached items (not shown) to the shoulder area 230 and prevent the belt B from riding low or sliding down about the hips of the user U. It should be noted that the arrangement of the pockets as described above is only a preferred disposition as regarding the location of the pockets and that a number of arbitrary changes could be made without departing from the spirit of the invention.

It is to be understood that the present invention is not limited to the embodiments described above, but encompasses any and all embodiments within the scope of the following claims.

I claim:

1. A utility vest comprising:

a) a body portion having:

1) a right front panel;

2) a left front panel;

3) a back panel integral with both of said front panels;

4) a shoulder area interconnecting said front panels with said back panel; and 5) an opening in each said panel;

6) at least two straps positioned interiorly of the vest, one of said straps communicating with both said left front panel and said back panel and another one of said straps communicating with both said right front panel and said back panel, each of said straps extending over said shoulder area and each of said straps having opposite ends, each of said ends having a loop integral therewith which extends through a respective said opening in the vest whereby said loops are located outside of the vest, each said loop being arranged and configured for receiving a belt.

2. The utility vest according to claim 1, further including a first fastening means to releasably fasten said right front panel to said left front panel thereby protecting the user from an ambient environment.

3. The utility vest according to claim 2, further including a storm flap for concealing said first fastening means when said storm flap is in a closed position, thereby further protecting the user from the ambient environment.

4. The utility vest according to claim 3, wherein said storm flap includes a second fastening means to maintain said storm flap in the closed position.

5. The utility vest according to claim 1, further including a pocket integral with said body portion.

6. The utility vest according to claim 5, wherein said pocket is pleated.

7. The utility vest according to claim 5, wherein said pocket is dimensioned and configured to receive a knife and a knife sheath.

8. The utility vest according to claim 5, further including a closure which overlaps an opening in said pocket when said closure is in a closed position.

9. The utility vest according to claim 8, wherein said closure includes means matingly engaged with said pocket to maintain said closure in said closed position.

10. The utility vest according to claim 1, further comprising backpack storage pocket means, having an interior surface integral with said body portion, said backpack storage pocket having a backpack stored therein, said backpack having length and width dimensions greater than the length and width dimensions of said backpack storage means, said backpack further being integrally connected with said interior surface and being foldable, said backpack being removable from said backpack storage pocket and unfolded to provide additional storage space.

11. The utility vest according to claim 10, wherein said backpack includes a fastening means to secure said backpack in a closed position.

12. The utility vest according to claim 10, wherein said backpack further includes a loop fastened thereto to receive a belt being worn about the midriff of the user which, in turn, secures said backpack substantially stationary relative to said body portion.

* * * * *